US009265109B2

(12) United States Patent
Muramatsu et al.

(10) Patent No.: US 9,265,109 B2
(45) Date of Patent: Feb. 16, 2016

(54) LIGHT SOURCE CONTROL DEVICE

(71) Applicant: Koito Manufacturing Co., Ltd., Tokyo (JP)

(72) Inventors: Takao Muramatsu, Shizuoka (JP); Masayasu Ito, Shizuoka (JP); Kazuki Saito, Shizuoka (JP)

(73) Assignee: KOITO MANUFACTURING CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 14/540,392

(22) PCT Filed: May 10, 2013

(86) PCT No.: PCT/JP2013/003009

§ 371 (c)(1),
(2) Date: Nov. 13, 2014

(87) PCT Pub. No.: WO2013/172006

PCT Pub. Date: Nov. 21, 2013

(65) Prior Publication Data

US 2015/0208476 A1 Jul. 23, 2015

(30) Foreign Application Priority Data

May 18, 2012 (JP) ..... 2012-114120

(51) Int. Cl.
*H05B 37/02* (2006.01)
*H05B 33/08* (2006.01)

(52) U.S. Cl.
CPC ..... *H05B 33/0827* (2013.01); *H05B 33/083* (2013.01); *H05B 33/089* (2013.01); *H05B 33/0815* (2013.01)

(58) Field of Classification Search
CPC ..... H05B 33/0893; H05B 37/036
USPC ..... 315/193, 210, 121, 123, 125
See application file for complete search history.

(56) References Cited

U.S. PATENT DOCUMENTS

2012/0062122 A1* 3/2012 Xi et al. ..... 315/120
2013/0313989 A1* 11/2013 Chen ..... 315/200 R

FOREIGN PATENT DOCUMENTS

CN 101682951 A 3/2010
CN 102265706 A 11/2011

(Continued)

OTHER PUBLICATIONS

International Preliminary Report on Patentability and the Written Opinion of the International Searching Authority (Forms PCT/IB/373 and PCT/ISA/237) issued on Nov. 18, 2014, by the International Bureau of WIPO in corresponding International Application No. PCT/JP2013/003009. (11 pages).
International Search Report (Form PCT/ISA/210) issued on Aug. 6, 2013, by the Japanese Patent Office in corresponding International Application No. PCT/JP2013/003009. (4 pages).

(Continued)

*Primary Examiner* — Daniel D Chang
(74) *Attorney, Agent, or Firm* — Buchanan Ingersoll & Rooney PC

(57) ABSTRACT

A semiconductor light source control device includes a driver circuit, which generates a drive current Iout flowing through a plurality of LEDs connected in series and which performs control such that the amount of the drive current is brought close to a target value, and bypass switches, which are on-off controlled by a control signal, the bypass switches being connected in parallel with the corresponding LEDs. The semiconductor light source control device is configured such that when the control signal indicates the off-state of the bypass switches, a voltage across the corresponding LEDs is clamped at an upper limit by using the bypass switches.

7 Claims, 7 Drawing Sheets

(56) References Cited

FOREIGN PATENT DOCUMENTS

| | | | |
|---|---|---|---|
| CN | 102316625 | A | 1/2012 |
| CN | 102461332 | A | 5/2012 |
| JP | 2001-313423 | A | 11/2001 |
| JP | 2005-183975 | A | 7/2005 |
| JP | 2005-341712 | A | 12/2005 |
| JP | 2010-272410 | A | 12/2010 |
| JP | 2011-192865 | A | 9/2011 |
| WO | 2010/004661 | A1 | 1/2010 |

OTHER PUBLICATIONS

Chinese Office Action with English translation,corresponding to Chinese Patent Application No. 201380025939.7, dated Jul. 7, 2015;14 pages.

Chinese Second Office Action with English translation, corresponding to Chinese Patent Application No. 201380025939.7, dated Dec. 9, 2015; 14 pages.

* cited by examiner

136

LIGHT SOURCE CONTROL DEVICE

BACKGROUND OF THE INVENTION

1. Field of the Invention

The present invention relates to a light source control device for controlling a light source.

2. Description of the Related Art

Over recent years, semiconductor light sources, such as light emitting diodes (LEDs), featuring longer operating life and low power consumption have been in use in substitution for the conventional halogen lamps having filaments. The degree of luminescence, namely the brightness, of LED depends on the amount of electric current supplied to the LED. For this reason, a lighting circuit for regulating the current flowing through the LED is required when the LED is utilized as the light source.

In Patent Document 1 in the following Related Art Documents, the present applicant proposes the technology where for the purpose of varying the light distribution of a headlamp and performing a fine-tuned control of light distribution, an array of LEDs are employed as the light sources, and these LEDs are separately turned on and off. In the lighting circuit cited in Patent Document 1 (Japanese Unexamined Patent Application Publication No. 2011-192865), a bypass switch is provided in parallel for each LED, and the on/off of the respective bypass switches individually turn on/off the respective LEDs.

Where such a bypass method as described in Patent Document 1 is employed, the wiring around the LED gets comparatively complicated. The complicated wiring may increase the chance of the conduction failure such as contact failure and disconnection to occur.

SUMMARY OF THE INVENTION

The present invention has been made in view of the foregoing circumstances, and a purpose thereof is to provide a light source control device capable of appropriately dealing with a case when a conduction failure occurs in the wiring around the light sources and the bypass switches.

One embodiment of the present invention relates to a light source control device. The light source control device includes: a driver circuit that generates a drive current flowing through a plurality of semiconductor light sources connected in series and that performs control such that an amount of the drive current is brought close to a target value; and a bypass switch that is on-off controlled by a control signal, the bypass switch being connected in parallel with at least part of the plurality of semiconductor light sources. The light source control device is configured such that when the control signal indicates off-state of the bypass switch, a voltage across the at least part of the plurality of semiconductor light sources is clamped at an upper limit by using the bypass switch.

In one embodiment, the upper limit of voltage across at least part of the plurality of semiconductor light sources is limited.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
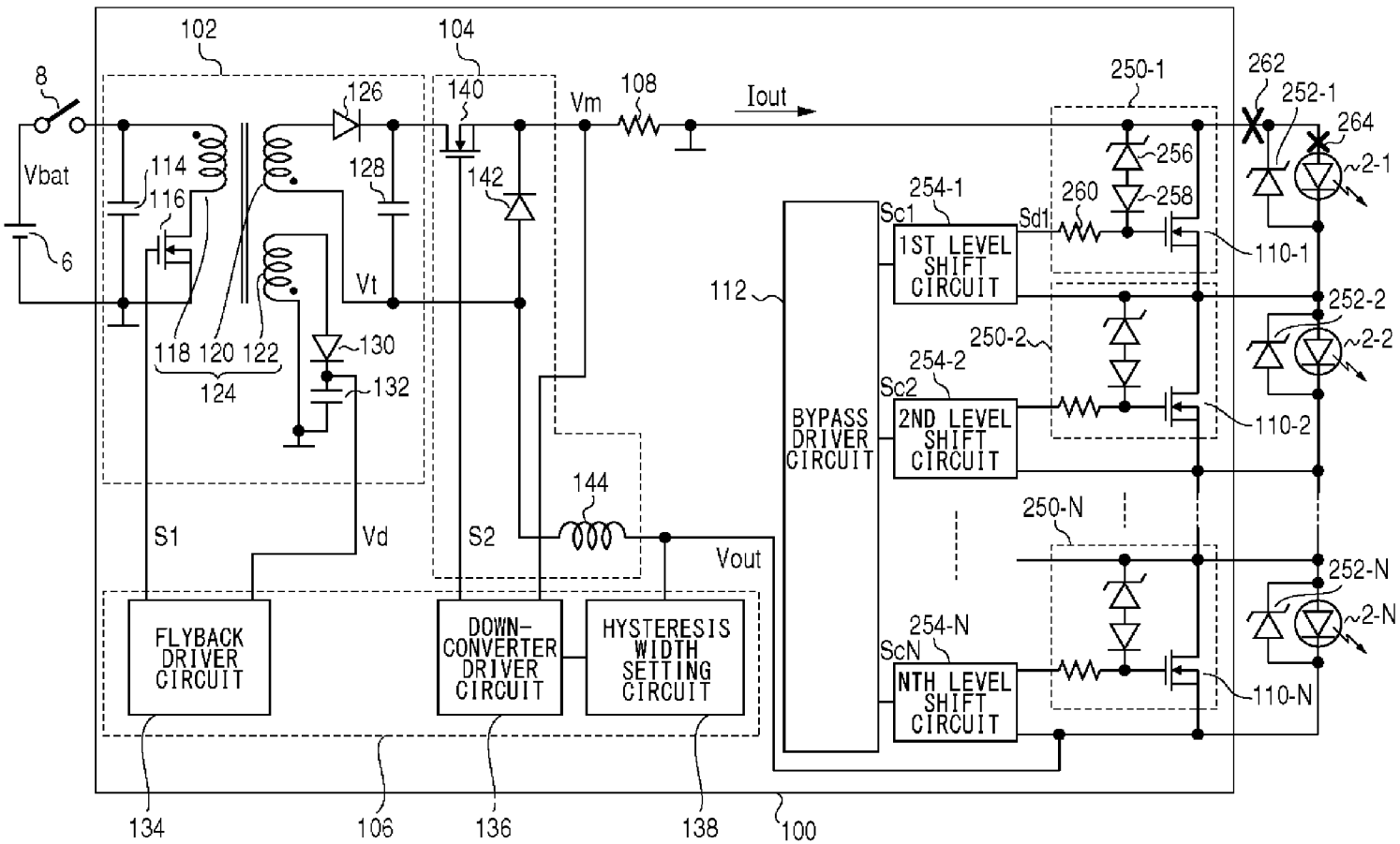
FIG. 1 is a circuit diagram showing a configuration of a semiconductor light source control device and its constituent members and components connected thereto according to an embodiment.

The same or equivalent constituents, members, or signals illustrated in each Figure will be hereinabelow denoted with the same reference numerals, and the repeated descriptions thereof will be omitted as appropriate. Some of the components and members in each Figure may be omitted if they are not important in the course of explanation. Also, the reference numerals assigned to a voltage, a current or a resistor may be used to indicate a voltage value, a current value or a resistance value, respectively, as necessary.

In the present specification, the state represented by the phrase "the member A is connected to the member B" includes a state in which the member A is indirectly connected to the member B via another member that does not affect the electric connection therebetween, in addition to a state in which the member A is physically and directly connected to the member B. Similarly, the state represented by the phrase "the member C is provided between the member A and the member B" includes a state in which the member A is indirectly connected to the member C, or the member B is indirectly connected to the member C via another member that does not affect the electric connection therebetween, in addition to a state in which the member A is directly connected to the member C, or the member B is directly connected to the member C.

A semiconductor light source control device according to an embodiment generates a drive current flowing through a plurality of light sources, namely LEDs, which are connected in series. A bypass switch is provided in parallel with each LED. When the bypass switch turns on (turns off), the corresponding LED turns off (turns on). The bypass switch functions as part of a limiter circuit that restricts the upper limit of voltage across the corresponding LED. Thereby, a voltage applied to the bypass switch can be clamped at an upper limit voltage even though there occurs a conduction failure such as contact failure and disconnection. As a result, an element having a lower breakdown voltage can be used as the bypass switch.

FIG. 1 is a circuit diagram showing a configuration of a semiconductor light source control device 100 and its constituent members and components connected thereto according to an embodiment. The semiconductor light source control device 100 supplies a drive current Iout to a plurality (N) of in-vehicle LEDs 2-1 to 2-N, which are connected in series, and turns on the LEDs 2-1 to 2-N. Here, N is an integer greater than or equal to "2". The semiconductor light source control device 100 and N LEDs 2-1 to 2-N are installed in an automotive lamp such as a headlamp. The semiconductor light source control device 100 is connected to an in-vehicle battery 6 and a power switch 8.

The in-vehicle battery 6 generates a direct-current (DC) battery voltage (power supply voltage) Vbat of 12 V (or 24 V). The power switch 8, which is connected in series with the in-vehicle battery 6, is a relay switch for controlling the on and off of N LEDs 2-1 to 2-N as a whole. When the power switch 8 is turned on, the battery voltage Vbat is supplied to the semiconductor light source control device 100 from a positive electrode terminal of the in-vehicle battery 6 as an input voltage. A negative electrode terminal of the in-vehicle battery 6 is connected to a fixed voltage terminal; that is, the negative electrode terminal thereof is grounded.

Electrostatic protection zener diodes 252-1 to 252-N are connected in parallel with and in reverse across the LEDs 2-1 to 2-N, respectively. That is, a cathode of the first electrostatic protection zener diode 252-1 is connected to an anode of the first LED 2-1, whereas an anode of the first electrostatic protection zener diodes 252-1 is connected to a cathode of the first LED 2-1. The same applies as to the second electrostatic protection zener diode 252-2 to the Nth electrostatic protection zener diode 252-N. The electrostatic zener diodes protect against the malfunctions of the corresponding LEDs caused by the static electricity.

The semiconductor light source control device 100 includes a switching regulator (namely, a flyback regulator) 102, a down-converter 104, a control circuit 106, a current sensing resistor 108, N bypass/limiter circuits 250-1 to 250-N, N level-shift circuits 254-1 to 254-N, and a bypass driver circuit 112. The control circuit 106 controls the flyback regulator 102 and the down-converter 104. The control circuit 106 includes a flyback driver circuit 134, a down-converter driver circuit 136, and a hysteresis width setting circuit 138.

The flyback regulator 102, which is a voltage regulator, receives the battery voltage Vbat and converts the battery voltage Vbat into a target voltage Vt, then outputs the target voltage Vt. Since a high-potential-side output terminal of the flyback regulator 102 is a grounding side, the target voltage Vt is a voltage applied to a low-potential-side output terminal of the flyback regulator 102 and has a negative polarity. The flyback regulator 102 includes an input capacitor 114, a first switching element 116, an input transformer 124, an output diode 126, an output capacitor 128, a voltage sensing diode 130, and a voltage sensing capacitor 132.

The input capacitor 114, which is provided in parallel with the in-vehicle battery 6, smooths out the battery voltage Vbat. More specifically, the input capacitor 114, which is located in the vicinity of the input transformer 124, performs a function of smoothing out the voltage for the switching operation of the flyback regulator 102.

A primary coil 118 of the input transformer 124 and the first switching element 116 are connected in series, and this series circuit is connected in parallel with the input capacitor 114 relative to the in-vehicle battery 6. The first switching element 116 is constructed of an N-channel MOSFET (Metal-Oxide-Semiconductor Field-Effect Transistor), for instance. One end of a secondary coil 120 of the input transformer 124 is connected to one end of the output capacitor 128, and the other end of the secondary coil 120 thereof is connected to an anode of the output diode 126. The other end of the output capacitor 128 is connected to a cathode of the output diode 126. The one end of the output capacitor 128 is connected to the low-potential-side output terminal of the flyback regulator 102, and the target voltage Vt is applied to the one end of the output capacitor 128. The other end of the output capacitor 128 is connected to the high-potential-side output terminal of the flyback regulator 102.

A pre-stage control signal S1 of rectangular wave shape generated by the flyback driver circuit 134 is applied to a control terminal (gate) of the first switching element 116. The first switching element 116 turns on when the pre-stage control signal S1 is asserted (i.e., goes high) and turns off when the pre-stage control signal S1 is negated (i.e., goes low).

A voltage sensing coil 122 of the input transformer 124, the voltage sensing diode 130 and the voltage sensing capacitor 132 constitute a positive-electrode voltage detecting circuit that is used to detect the magnitude of the target voltage Vt as a positive-polarity voltage. One end of the voltage sensing coil 122 is grounded, and the other end thereof is connected to an anode of the voltage sensing diode 130. A cathode of the voltage sensing diode 130 is connected to one end of the voltage sensing capacitor 132. The other end of the voltage sensing capacitor 132 is grounded. A positive voltage corresponding to the absolute value of the target voltage Vt is applied to the one end of the voltage sensing capacitor 132. This voltage is supplied to the flyback driver circuit 134 as a detection voltage Vd.

The flyback driver circuit 134 performs a voltage feedback control based on the detection voltage Vd. Here, the voltage feedback control is performed for the purpose of keeping the target voltage Vt appropriately constant. The flyback driver circuit 134 adjusts the frequency and the duty ratio of the pre-stage control signal S1 so that the target voltage Vt can be brought close to the setting voltage of about −100 V, for instance.

The down-converter 104, which is provided in a position subsequent to the flyback regulator 102, includes a second switching element 140, a flywheel diode 142 and an inductor 144 but does not include an output voltage smoothing capacitor.

The second switching element 140 is constructed of an N-channel MOSFET, for instance. A post-stage control signal S2 of rectangular wave shape generated by the down-converter driver circuit 136 is applied to a control terminal of the second switching element 140. The second switching element 140 turns on when the post-stage control signal S2 goes high and turns off when the post-stage control signal S2 goes low. A drain of the second switching element 140 is connected to a high-potential side of the output capacitor 128, namely a high-potential-side output terminal of the flyback regulator 102. A source of the second switching element 140 is connected to a cathode of the flywheel diode 142.

An anode of the flywheel diode 142 is connected to one end of the inductor 144. A connection node of the anode of the flywheel diode 142 and the one end of the inductor 144 is connected to a low-potential side of the output capacitor 128, namely a low-potential-side output terminal of the flyback regulator 102. The other end of the inductor 144 is connected to a cathode side of N LEDs 2-1 to 2-N.

The current sensing resistor 108 is provided on a route of the drive current Iout. One end of the current sensing resistor 108 is connected to the source of the second switching element 140 and the cathode of the flywheel diode 142. The other end of the current sensing resistor 108 is both grounded and connected to an anode side of the N LEDs 2-1 to 2-N. A voltage drop Vm proportional to the drive current Iout occurs across the current sensing resistor 108.

Since the anode side of the N LEDs 2-1 to 2-N is grounded, a drive voltage Vout having a negative polarity is applied to the cathode side of the N LEDs 2-1 to 2-N, namely the other end of the inductor 144. During a period of normal lighting operation, the drive voltage Vout is a negative voltage whose magnitude is equal to:

[the number of LEDs in the light emitting state]×[Forward voltage Vf in each of the LEDs], where the "LEDs are in the light emitting state" means that the corresponding bypass switches are turned off.

The down-converter driver circuit 136 performs a current feedback control based on the voltage drop Vm. Here, the current feedback control is performed for the purpose of keeping the drive current Iout within a predetermined current range. The down-converter driver circuit 136 turns off the second switching element 140 when the amount of the drive current Iout exceeds a predetermined upper limit of current Ith1, and turns on the second switching element 140 when the amount thereof falls below a lower limit of current Ith2, which is smaller than the upper limit of current Ith1. The down-converter driver circuit 136 sets the post-stage control signal S2 low when the amount of the drive current Iout exceeds the upper limit of current Ith1, and sets the post-stage control signal S2 high when the amount thereof falls below the lower limit of current Ith2.

The hysteresis width setting circuit 138 sets a hysteresis width ΔI, which is a difference between the upper limit of current Ith1 and the lower limit of current Ith2, based on the drive voltage Vout. When the absolute value of the drive value Vout falls below a voltage threshold value Vth, which is smaller than the absolute value of the target voltage Vt, the hysteresis width setting circuit 138 sets the hysteresis width ΔI to a larger value as the absolute value of the drive voltage Vout becomes larger. When the absolute value of the drive value Vout exceeds the voltage threshold value Vth, the hysteresis width setting circuit 138 sets the hysteresis width ΔI to a smaller value as the absolute value of the drive voltage Vout becomes larger.

Figure 2:
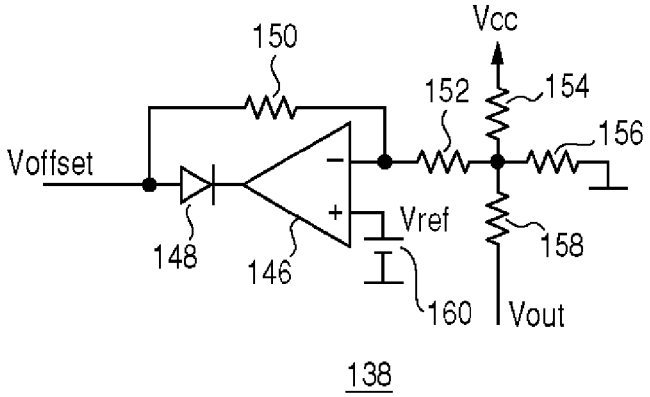
FIG. 2 is a circuit diagram showing a configuration of a hysteresis width setting circuit.

FIG. 2 is a circuit diagram showing a configuration of the hysteresis width setting circuit 138. The hysteresis width setting circuit 138 includes a first operational amplifier 146, a first diode 148, a first resistor 150, a second resistor 152, a third resistor 154, a fourth resistor 156, a fifth resistor 158, and a reference voltage source 160. A control source voltage Vcc is applied to one end of the third resistor 154. The other end of the third resistor 154 is connected to one end of the second resistor 152, one end of the fifth resistor 158 and one end of the fourth resistor 156. The other end of the fourth resistor 156 is grounded. The drive voltage Vout is applied to the other end of the fifth resistor 158. The other end of the second resistor 152 is connected to an inverting input terminal of the first operational amplifier 146. The inverting input terminal of the first operational amplifier 146 is connected to an anode of the first diode 148 by way of the first resistor 150. A cathode of the first diode 148 is connected to an output terminal of the first operational amplifier 146. A reference voltage Vref generated by the reference voltage source 160 is applied to a non-inverting input terminal of the first operational amplifier 146. A voltage applied to the anode of the first diode 148 is called an offset voltage Voffset. As will be discussed later, the offset voltage Voffset corresponds to the hysteresis width ΔI; the higher the offset voltage Voffset is, the larger the hysteresis width ΔI will be.

As for the values of resistance surrounding the first operational amplifier 146, the values of the first resistor 150 and the second resistor 152, by which the gain of the first operational amplifier 146 is determined, are set to sufficiently large values relative to the values of the third resistor 154, the fourth resistor 156 and the fifth resistor 158, which are differentials from the reference voltage Vref. Thereby, a feedback current does not affect the differentials from the reference voltage Vref.

Figure 3:
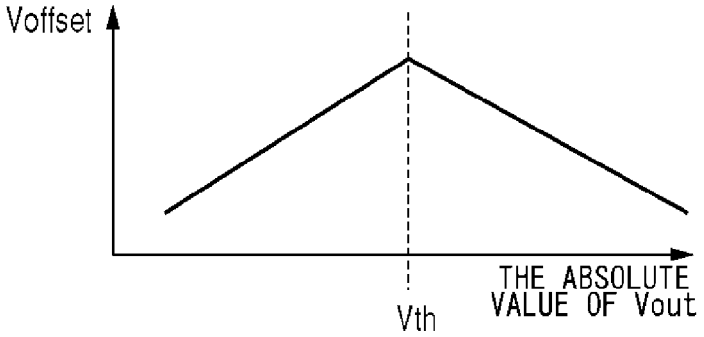
FIG. 3 is a graph showing a relation between the absolute value of a drive voltage and an offset voltage.

FIG. 3 is a graph showing a relation between the absolute value of a drive voltage and an offset voltage. When the drive voltage Vout having the negative polarity is small, a common connection node of the third resistor 154, the fourth resistor 156 and the fifth resistor 158 is larger than the reference voltage Vref. This causes the first operational amplifier 146 to current-sink through those resistors, and thereby the offset voltage Voffset becomes small. The offset voltage Voffset becomes the maximum when the voltage at the common connection node (hereinafter referred to as "common connection node voltage" also) is equal to the reference voltage Vref.

In order to achieve a control whereby the hysteresis width ΔI, namely the offset voltage Voffset, becomes the maximum when the absolute value of the drive voltage Vout reaches the voltage threshold value Vth, the reference voltage Vref is set to the common connection node voltage assumed when the absolute value of the drive voltage Vout is equal to the voltage threshold value Vth. When, in particular, the setting voltage of the flyback regulator 102 is −100 V, the reference voltage Vref is set to a common connection node voltage assumed when the drive voltage Vout=−Vth=−50 V.

When the absolute value of the drive voltage Vout becomes large exceeding the voltage threshold value Vth, the action of the first operational amplifier 146 is no longer in effect and therefore the common connection node voltage directly becomes the offset voltage Voffset. The hysteresis width setting circuit 138 sends the offset voltage Voffset, which varies in an inverted V-shaped manner as shown in FIG. 3, to the down-converter driver circuit 136. Thereby, the hysteresis width ΔI is controlled and the switching frequency of the down-converter 104 is made to lie within a predetermined range.

Figure 4:
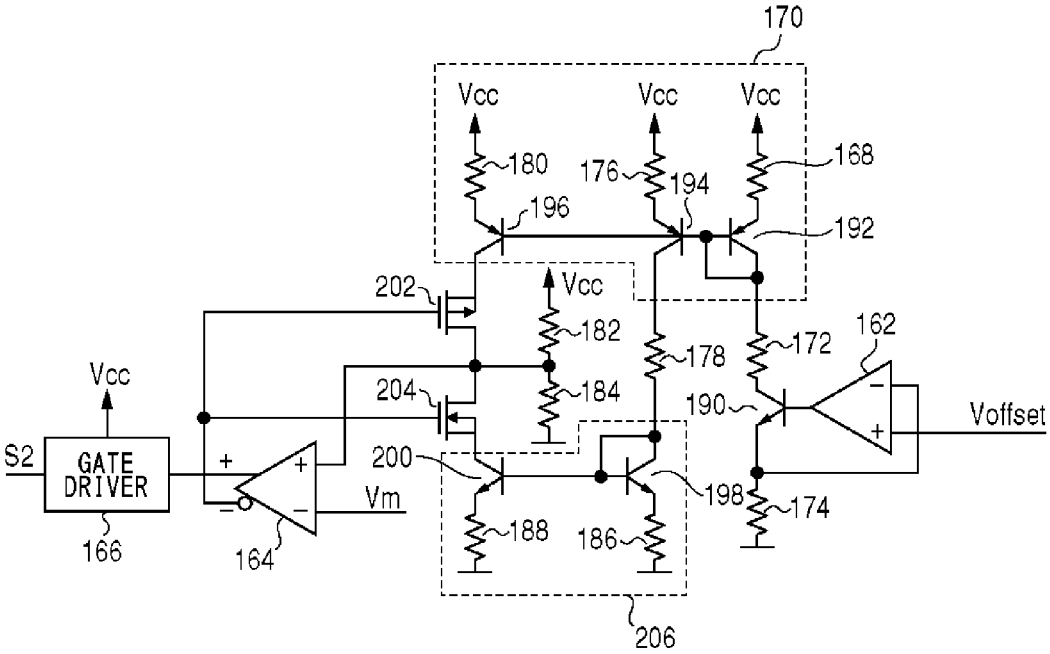
FIG. 4 is a circuit diagram showing a down-converter driver circuit of FIG. 1.

FIG. 4 is a circuit diagram showing the down-converter driver circuit 136. The down-converter driver circuit 136 includes a second operational amplifier 162, a comparator 164, a gate driver 166, a first current mirror circuit 170, a seventh resistor 172, an eighth resistor 174, a tenth resistor 178, a twelfth resistor 182, a thirteenth resistor 184, a first npn bipolar transistor 190, a third switching element 202, a fourth switching element 204, a second current mirror circuit 206.

The offset voltage Voffset is applied to a non-inverting input terminal of the second operational amplifier 162. An output terminal of the second operational amplifier 162 is connected to a base of the first npn bipolar transistor 190, and an inverting input terminal is connected to an emitter of the first npn bipolar transistor 190. One end of the eighth resistor 174 is connected to the emitter of the first npn bipolar transistor 190, and the other end thereof is grounded. A collector of the first npn bipolar transistor 190 is connected to the first current mirror circuit 170 by way of the seventh resistor 172.

The first current mirror circuit 170 includes a sixth resistor 168, a ninth resistor 176, an eleventh resistor 180, a first pnp bipolar transistor 192, a second pnp bipolar transistor 194, and a third pnp bipolar transistor 196. These circuit elements are connected to each other such that they constitute a known current mirror circuit. In the first current mirror circuit 170, the current flowing through the seventh resistor 172 serves as an input, the current flowing through the tenth resistor 178 servers as an output, and the amount of input current and that of output current are approximately equal to each other.

The second current mirror circuit 206 includes a fourteenth resistor 186, a fifteenth resistor 188, a second npn bipolar transistor 198, and a third npn bipolar transistor 200. These circuit elements are connected to each other such that they constitute a known current mirror circuit. In the second current mirror circuit 206, the current flowing through the tenth resistor 178 serves as an input, the current flowing through the fourth switching element 204 servers as an output, and the amount of input current and that of output current are approximately equal to each other.

The third switching element 202 is constructed of a P-channel MOSFET, for instance. The fourth switching element 204 is constructed of an N-channel MOSFET, for instance. A source of the third switching element 202 is connected to the first current mirror circuit 170. A gate of the third switching element 202 is connected to an inverting output terminal of the comparator 164. A drain of the third switching element 202 is connected to a drain of the fourth switching element 204. A gate of the fourth switching element 204 is connected to the inverting output terminal of the comparator 164. A source of the fourth switching element 204 is connected to the second current mirror circuit 206.

The twelfth resistor 182 and the thirteenth resistor 184 are connected in series between the control source voltage Vcc and a ground potential, in this order. A connection node of the twelfth resistor 182 and the thirteenth resistor 184 is connected to a connection node of the drain of the third switching element 202 and the drain of the fourth switching element 204. A connection node of the drain of the third switching element 202 and the drain of the fourth switching element 204 is connected to a non-inverting input terminal of the comparator 164. The voltage drop Vm is applied to an inverting input terminal of the comparator 164.

A non-inverting output terminal of the comparator 164 is connected to the gate driver 166. The gate driver 166 aligns the phase of the post-stage control signal S2 to the phase of a signal that appears at the non-inverting output terminal of the comparator 164. In other words, when the signal appearing at the non-inverting output terminal of the comparator 164 goes high (low), the gate driver 166 sets the post-stage control signal S2 to a high level (low level).

The second operational amplifier 162 and the first npn bipolar transistor 190, to both of which the offset voltage Voffset is input, output the current equal to Voffset/[the resistance value of the eighth resistor 174]. This current is sunk or sourced into the voltage division node of the twelfth resistor 182 and the thirteenth resistor 184 by a phase of output of the comparator 164 to which the voltage drop Vm is input. At the timing when the gate of the second switching element 140 goes high (the second switching element 140 is turned on) in a bridge configuration of the third switching element 202 and the fourth switching element 204, the third switching element 202 is turned on, the voltage division node of the twelfth resistor 182 and the thirteenth resistor 184 rises and an upper limit of current Ith1 is set. As the drive current Iout rises and then reaches the upper limit of current Ith1, the gate of the second switching element 140 goes low (the second switching element 140 is turned off) and, practically simultaneously, the fourth switching element 204 is turned on. As a result, the voltage division node of the twelfth resistor 182 and the thirteenth resistor 184 drops and then a lower limit of current Ith2 is set.

An average value of the drive current Iout is set by a divided voltage of the twelfth resistor 182 and the thirteenth resistor 184. As the absolute value of the drive voltage Vout is close to the voltage threshold value Vth, the sink/source current becomes large due to an operation of the hysteresis width setting circuit 138. Hence, the value of {[the upper limit of current Ith1]−[the lower limit of current Ith2]=[the hysteresis width ΔI]} becomes large. The farther the absolute value of the drive voltage Vout is away from the voltage threshold value Vth, the smaller the hysteresis width ΔI will be. As will be discussed later, this is because the hysteresis width setting circuit 138 operates so that the switching frequency of the down-converter 104 can lie within a predetermined range.

Referring back to FIG. 1, the semiconductor light source control device 100 is configured such that the turning on and off of N LEDs 2-1 to 2-N can be controlled separately. The bypass driver circuit 112 generates N on/off control signals Sc1 to ScN, which are used to control the turning on and off of the respective LEDs 2-1 to 2-N. The bypass driver circuit 112 separately controls the level of each of the on/off signals Sc1 to ScN so that a desired luminance or light pattern can be achieved. More specifically, the bypass driver circuit 112 sets a first on/off control signal Sc1 to a low level when the first LED 2-1 is to turn on, and sets the first on/off control signal Sc1 to a high level when the first LED 2-1 is to turn off. The same applies to the second on/off control signal Sc2 to the Nth on/off control signal ScN. The bypass driver circuit 112 outputs the on/off control signals Sc1 to ScN to their corresponding level-shift circuits 254-1 to 254-N, respectively.

The first level-shift circuit 254-1 receives the first on/off control signal Sc1 from the bypass driver circuit 112, and converts it into a first bypass switch drive signal Sd1 with which the voltage of a cathode of the first LED 2-1 serves as a reference, namely, with which the voltage of the cathode thereof goes low. Though the phase of the first bypass switch drive signal Sd1 is aligned to the phase of the first on/off control signal Sc1, a low level of the first bypass switch drive signal Sd1 becomes a voltage of the cathode of the first LED 2-1. Similarly, the second level-shift circuit 254-2 to the Nth level-shift circuit 254-N level-shift the second on/off control signal Sc2 to the Nth on-off control signal ScN, respectively, and then supply the thus level-shifted signals to their corresponding second to Nth bypass/limiter circuits 250-2 to 250-N, respectively.

The first bypass/limiter circuit 250-1 includes a first bypass switch 110-1, which is connected in parallel with the first LED 2-1. The first bypass/limiter circuit 250-1 turns on (off) the first LED 2-1 by turning on (off) the first bypass switch 110-1 when the first bypass switch drive signal Sd1 goes high (low). Further, the first bypass/limiter circuit 250-1 is configured such that when the first bypass switch drive signal Sd1 is in a low level, the voltage across the first LED 2-1 is clamped at an upper limit voltage by using the first bypass switch 110-1. In particular, the upper limit of voltage across the first LED 2-1 is set such that the upper limit thereof is higher than the maximum value of the forward voltage Vf of the LED and such that the upper limit is lower than a zener voltage determined by the first electrostatic protection zener diode 252-1.

The first bypass/limiter circuit 250-1 includes a limiter zener diode 256, a back-flow preventing diode 258, a sixteenth resistor 260, and the first bypass switch 110-1. The first bypass switch 110-1 is constructed of an N-channel MOSFET, for instance.

A cathode of the limiter zener diode 256 is connected to a drain of the first bypass switch 110-1. A connection node of the cathode of the limiter zener diode 256 and the drain of the first bypass switch 110-1 is connected to the other end of the current sensing resistor 108 and is also connected to a connection node of the anode of the first LED 2-1 and the cathode of the first electrostatic protection zener diode 252-1. An anode of the limiter zener diode 256 is connected to an anode of the back-flow preventing diode 258. The first bypass switch drive signal Sd1 is input to a gate of the first bypass switch 110-1 via the sixteenth resistor 260. A source of the first bypass switch 110-1 is connected to a connection node of the cathode of the first LED 2-1 and the anode of the first electrostatic protection zener diode 252-1.

A series circuit composed of the limiter zener diode 256 and the back-flow preventing diode 258 is connected on a gate side of the first bypass switch 110-1 than the first bypass switch drive signal Sd1 with which to turn on/off the first bypass switch 110-1. In other words, the cathode of the back-flow preventing diode 258 is connected between the sixteenth resistor 260 and the gate of the first bypass switch 110.

Assume here that the zener voltage of the limiter zener diode 256 is 7 V, the forward voltage Vf of the back-flow preventing diode 258 is 0.5 V, and a gate threshold voltage of the first bypass switch 110-1 is 2.5 V. Then, the first bypass switch 110-1 starts to turn on when a drain-source voltage thereof has reached 10 V. Hence, the upper limit of the voltage across the first LED 2-1 is 10 V. Also, assume here that the maximum value of the forward voltage Vf of the LED is 6 V and the zener voltage of the first electrostatic protection zener diode 252-1 is 20 V. Then, the zener voltage of the limiter zener diode 256 is set in a range of 3 V to 17 V.

The back-flow preventing diode 258 is used not to inhibit the on/off of the first bypass switch 110-1 by the first bypass switch drive signal Sd1. Suppose, for example, that the first bypass switch 110-1 is turned on when the first LED 2-1 (which is connected in parallel with the first bypass switch 110-1) is to be turned off or as a result of measures taken against a contact failure and a disconnection as described later. If, in this case, no back-flow preventing diode 258 is provided, the gate voltage of the first bypass switch 110-1 will drop, via the first bypass switch 110-1 that is being turned on, from a forward direction of the limiter zener diode 256. The back-flow preventing diode 258 prevents such a situation from occurring.

The second bypass/limiter circuit 250-2 to the Nth bypass/limiter circuit 250-N are each configured similarly to the first bypass/limiter circuit 250-1.

Figure 5A:
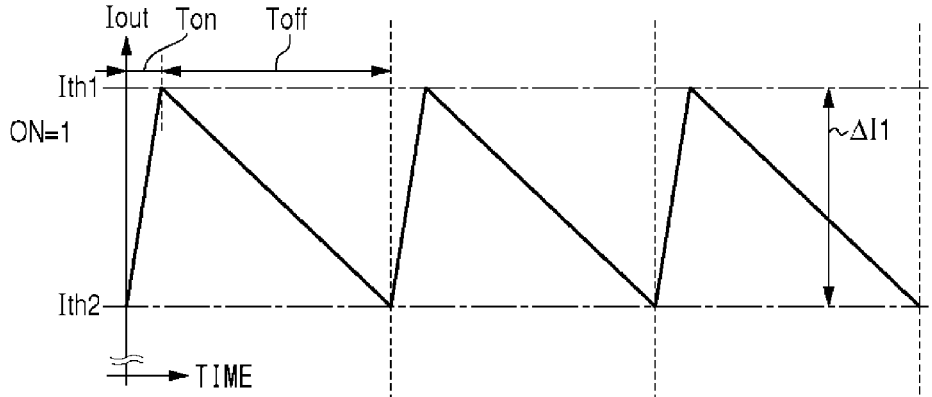
FIGS. 5A to 5C are graphs each showing a temporal change in the drive current.
Figure 5B:
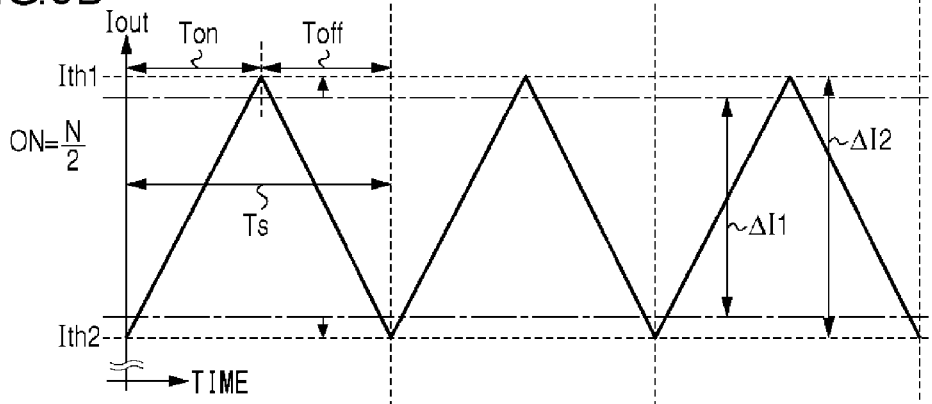
Figure 5C:
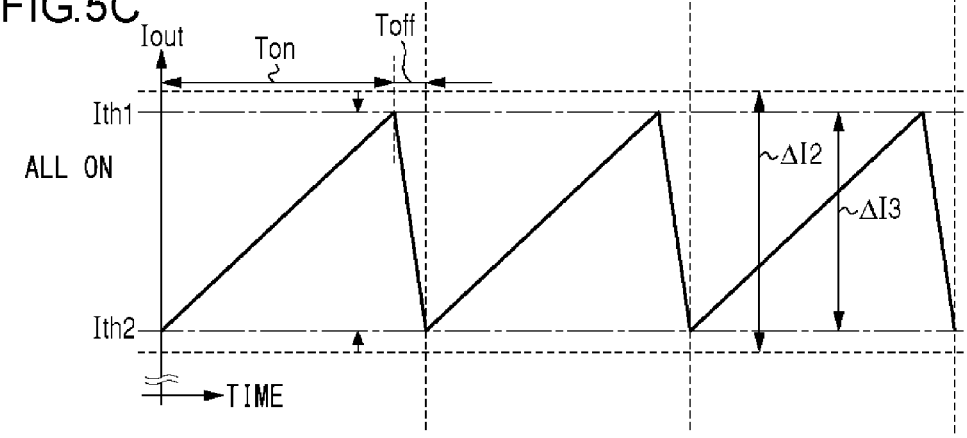

An operation of the semiconductor light source control device 100 configured as above is now described. FIGS. 5A to 5C are graphs each showing a temporal change in the drive current Iout. Consider first that a single LED is turned on, then consider that about a half of the LEDs are turned on, and finally consider that all of the LEDs are turned on. FIG. 5A shows a temporal change in the drive current Iout, when a single LED only is turned on and the remaining N−1 LEDs are turned off by turning on their corresponding bypass switches. FIG. 5B shows a temporal change in the drive current Iout, when about a half of the LEDs, namely N/2 LEDs, are turned on and the remaining LEDs are turned off. FIG. 5C shows a temporal change in the drive current Iout, when all of the LEDs are turned on.

FIG. 5A to FIG. 5C show cases where the hysteresis width ΔI is regulated such that the switching frequency of the second switching element 140, namely the switching cycle Ts, is approximately constant irrespective of the number of ONs and the number of OFFs in the LED(s) in use. In the present embodiment, it will be understood by a person skilled in the art, who reads this patent specification disclosed herein, that the hysteresis width ΔI is controlled preferably in manner such that the change in the switching cycle Is due to the change in the number of ONs and the number of OFFs in the LED(s) in use can be restricted.

Referring to FIG. 5A, in the case where the number of LEDs to be turned on is small, the drive current Iout rises relatively quickly during an ON-time Ton of the second switching element 140, and the drive current Iout drops relatively slowly during an OFF-time Toff of the second switching element 140. The then hysteresis width is denoted by ΔI1. The absolute value of the drive voltage Vout is relatively low, and the offset voltage Voffset generated by the hysteresis width setting circuit 138 is relatively low, too.

Referring to FIG. 5B, in the case where the number of LEDs to be turned on and the number of LEDs to be turned off are equal or approximately equal to each other, the drive voltage Vout is about a half of the setting voltage of the flyback regulator 102, and the ON-time Ton of the second switching element 140 and the OFF-time Toff thereof are balanced. An overall rate of change in the drive current Iout is greater than that when the number of LEDs to be turned on is small.

As shown in FIG. 3, the hysteresis width setting circuit 138 generates a higher offset voltage Voffset. The down-converter driver circuit 136, which receives the high offset voltage Voffset, sets a hysteresis width ΔI2 such that the hysteresis width ΔI2 is greater than the hysteresis width ΔI1 set when the number of LEDs to be turned on is one. As a result, an increase in the overall rate of change in the drive current Iout is cancelled out and therefore the switching cycle Ts is kept approximately constant.

Referring to FIG. 5C, in the case where the number of LEDs to be turned off is small or none, the drive current Iout rises relatively slowly during the ON-time Ton of the second switching element 140, and the drive current Iout drops relatively quickly during the OFF-time Toff of the second switching element 140. The overall rate of change in the drive current Iout is smaller than that when the number of LEDs to be turned on and the number thereof to be turned off are balanced. The absolute value of the drive voltage Vout is relatively high, and the offset voltage Voffset generated by the hysteresis width setting circuit 138 is relatively low.

The down-converter driver circuit 136, which receives the low offset voltage Voffset, sets a hysteresis width ΔI3 such that the hysteresis width ΔI3 is smaller than the hysteresis width ΔI2 set when the number of LEDs to be turned on and the number thereof to be turned off are balanced. As a result, a decrease in the overall rate of change in the drive current Iout is cancelled out and therefore the switching cycle Is is kept approximately constant.

By employing the semiconductor light source control device 100 according to the present embodiment, an increase in voltage applied to the bypass switch can be suppressed even in the event that there occurs a conduction failure such as contact failure and disconnection on the route of the drive current Iout. Consider herein, for example, a case where, when the first LED 2-1 is being turned on, namely the first bypass switch 110-1 is being turned off, a contact failure or disconnection occurs in the wiring upstream of a connection node of the anode of the first LED 2-1 and the cathode of the first electrostatic protection zener diode 252-1, namely in the wiring marked with "X" and denoted by a reference numeral 262 in the circuitry shown in FIG. 1.

As the control circuit 106 detects that no drive current Iout flows, the control circuit 106 checks to identify which wiring or LED the disconnection has occurred. In case shown in FIG. 1, the control circuit 106 turns on the first bypass switch 110-1 so that the other LEDs can light.

However, this action of taking measures against the disconnection, if any, normally takes time of several tens to several hundreds of milliseconds. Assume that the semiconductor light source control device does not have the limiter function according to the present embodiment. In this case, a relatively high voltage of several kV (in absolute value), which is determined by the energy stored in the inductor 144 and the parasitic capacitance of the first bypass switch, is outputted immediately after the aforementioned contact failure and/or disconnection have/has occurred. This is because no capacitor, which is used to smooth out the output voltage, is provided. Such a high voltage as this is applied to the first bypass switch before the first bypass switch is turned on. Thus, in this case, an element having a high breakdown voltage of several kV needs to be selected in consideration of contact failure and disconnection even though only a small voltage of a several V is applied during a period of normal lighting operation.

In contrast to the above case, by employing the semiconductor light source control device 100 having the limiter function according to the present embodiment, the increase in the voltage is restricted by the their own operations of the limiter zener diode 256 and the first bypass switch 110-1, although the drain-source voltage of the first bypass switch 110-1 rises when the aforementioned contact failure and/or disconnection occur/occurs. Thus, even allowing for the contact failure and disconnection that may occur, an element having a lower breakdown voltage can be selected as the first bypass switch 110.

When a disconnection or contact failure occurs, an electric power of about 10 W (=10[V]×1[A]) is applied to the first bypass switch 110-1 for several tens to several hundreds of milliseconds, for instance. Since, however, the ON-resistance is small in the first place and the use of a somewhat large device is required, the effects on the device size and cost are minimum.

Consider now, for example, a case where, when the first LED 2-1 is being turned on, namely the first bypass switch 110-1 is being turned off, a contact failure or disconnection occurs in the wiring downstream of the connection node of the anode of the first LED 2-1 and the cathode of the first electrostatic protection zener diode 252-1, namely in the wiring marked with "x" and denoted by a reference numeral 264 in the circuitry shown in FIG. 1. If the semiconductor light source control device does not have the limiter function according to the present embodiment, the most of energy stored in the inductor 144 will be consumed by the first electrostatic protection zener diode. Thus, an element, which can withstand against a large power consumption in the event of a contact failure or disconnection occurs, needs to be selected as the first electrostatic protection zener diode. Or alternatively, conceivable is the use of an element having a higher zener voltage than a voltage of several kV that may possibly be generated in the event of the contact failure or disconnection. If, however, the zener voltage is generally high like that, such the element cannot achieve the electrostatic protection role required in the first place.

In contrast to the above case, by employing the semiconductor light source control device 100 having the limiter function according to the present embodiment, the upper limit of voltage across the first LED 2-1 is set such that the upper limit thereof is lower than a zener voltage determined by the first electrostatic protection zener diode 252-1. Thus, a relatively small zener diode can be selected as the first electrostatic protection zener diode 252-1.

When the similar connection failure and/or disconnection occur/occurs in any of the second LED 2-2 to the Nth LED 2-N, the upper limit of voltage applied to the corresponding bypass switch and the electrostatic protection zener diode is restricted in a similar manner. Thus, an element having a lower breakdown voltage can be used as the corresponding bypass switch, and a relatively small zener diode can be used as the corresponding electrostatic protection zener diode.

In the semiconductor light source control device 100 according to the present embodiment, the bypass switch for controlling the turning on and off of the LED is also used as a switch for achieving the limiter function for the voltage across the LED. In other words, the bypass switch is commonly used for both the control function for turning on and off the LED (LED on/off control function) and the limiter function. This can restrict the increase in the number of elements used, while the LED on/off control function and the limiter function are achieved.

In the semiconductor light source control device 100 according to the present embodiment, no smoothing capacitors is provided in an output stage that leads to N LEDs 2-1 to 2-N. This enhances the follow-up property of the drive current Iout for the second switching element 140. In particular, the drive current Iout becomes small when the second switching element 140 is turned off, and the drive current Iout becomes large when the second switching element 140 is turned on. In order to stabilize the drive current Iout near a target value, the drive current Iout is subjected to a hysteresis control instead of the smoothing process. As a result of these, the response in the current feedback can be made faster. When, for example, the number of ONs in LEDs varies due to the operations of the bypass driver circuit 112 and the bypass switch, the drive current Iout can be made to more quickly follow such a change in the load. In particular, an undershoot of the drive current Iout, which may occur when the number of ONs in the LEDs is increased, and an overshoot thereof, which may occur when the number thereof is reduced, can be suppressed.

Also, in the semiconductor light source control device 100 according to the present embodiment, the flyback regulator 102, which is provided in a preceding (upstream) stage, has a negative output, and the down-converter 104, which is provided in a stage subsequent to (downstream of) the flyback regulator 102, has a negative output as well. Thus, an N-channel MOSFET having more satisfactory characteristics can be used as the bypass switch.

In addition to having the negative output, the inductor 144 is provided between the anode of the flywheel diode 142 and the output instead of between the cathode thereof and the output, so that an N-channel MOSFET having more satisfactory characteristics can be used as the second switching element 140 of the down-converter 104. Also, the drive voltage Vout can be detected stably.

Assume that the semiconductor light source control device has a positive output. In that case, the drive current is often detected on a high side in case the LED is ground-faulted. If, in that case, the load varies, the potential at a point where the detection is performed will also vary and therefore it will be difficult to accurately detect the drive current. This may cause the configuration of a detection circuit to be complicated. In the light of these problems, the negative output is used in the semiconductor light source control device 100 according to the present embodiment, and the current sensing resistor 108 is provided on a positive side, namely the ground side. Hence, even if the load (the drive voltage Vout) varies, the effect of such a change in the drive voltage Vout on the potential at the point where the drive current Iout is detected will be minimum and therefore the drive current Iout can be detected stably. Also, the configuration of the detection circuit can be simplified.

As both of or either one of an input voltage to the down-converter 104 and the drive voltage Vout vary or varies when the drive current Iout is subjected to the hysteresis control, the slopes of rise and drop of the drive current Iout vary, too. This may possibly change the switching frequency of the second switching element 140. Thus, in the semiconductor light source control device 100, the hysteresis width ΔI is regulated such that the variation in the switching frequency thereof is restricted. In particular, a targeted switching frequency is set so that a frequency band, such as a known radio noise, can be avoided. Thereby, the adverse effects of the radio noise on the semiconductor light source control device 100 can be prevented.

Also, in the semiconductor light source control device 100 according to the present embodiment, the variation, in the input voltage to the down-converter 104, which is caused by the variation in the battery voltage Vbat is restricted by the operation of the flyback regulator 102. Thus, the variation in the switching frequency caused by the variation in the input voltage to the down-converter 104 is restricted. In other words, there is no need to select a hysteresis width ΔI by a combination of the input voltage to the down-converter 104 and the drive voltage Vout. Instead, the hysteresis width ΔI may be selected based mainly on the drive voltage Vout, and therefore the control performed for the purpose of regulating the hysteresis width ΔI is further simplified. This contributes to the downsizing and a higher speed of the control circuit.

In the semiconductor light source control device 100 according to the present embodiment, the output capacitor 128 is provided in an output stage of the flyback regulator 102. If the second switching element 140 is being turned on when the bypass switch is turned on, the electric charge stored in the output capacitor 128 will flow to the LEDs instantaneously. In the semiconductor light source control device 100, however, the inductor 144 is provided on the route of the drive current Iout. Thus, such an instantaneous flow of the electric charge thereto is smoothed out with the result that the overshoot of the drive current Iout is suppressed. Similarly, the undershoot thereof is suppressed when the bypass switch is turned off.

Now, consider a semiconductor light source lighting circuit 300 according to the following comparative example, which is uniquely created for the purpose of suppressing of the overshoot and the undershoot of the drive current Iout at the time the bypass switches are switched.

Figure 6:
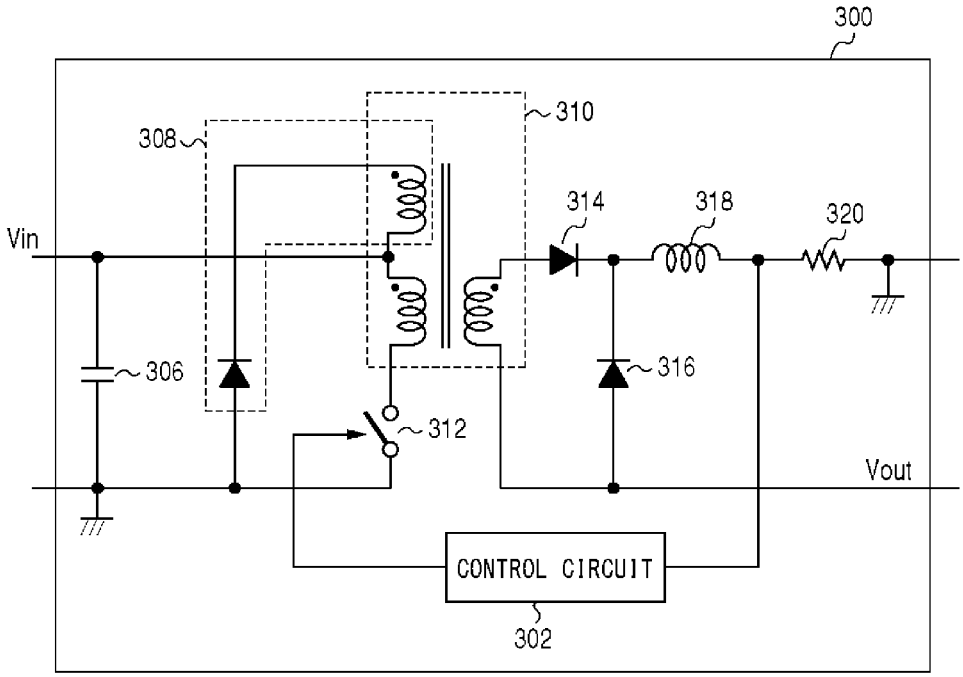
FIG. 6 is a circuit diagram showing a configuration of a semiconductor light source lighting circuit according to a comparative example.

FIG. 6 is a circuit diagram showing a configuration of the semiconductor light source lighting circuit 300 according to a comparative example. The semiconductor light source lighting circuit 300 is a forward converter that basically does not use a smoothing capacitor. The semiconductor light source lighting circuit 300 includes a control circuit 302, an input capacitor 306, a reset circuit 308, a transformer 310, a fifth switching element 312, a second diode 314, a third diode 316, an inductor 318, and a current sensing resistor 320. The control circuit 302 turns off the fifth switching element 312 when the amount of the drive current exceeds a predetermined current upper limit, and turns on the fifth switching element 312 when the amount thereof falls below a current lower limit.

For the semiconductor light source lighting circuit 300, the turns ratio of the transformer 310 is denoted by Ns/p, the inductance of the inductor 318 is denoted by Ls', the hysteresis width of the drive current is denoted by ΔI', the input voltage is denoted by Vin, the output voltage is denoted by Vout (<0), the ON-time of the fifth switching element 312 is denoted by Ton', the OFF-time thereof is Toff', and the switching frequency is F'. Further, the forward voltage of a rectifying diode is ignored because it is negligibly small. Then, "F'" can be derived from the following Equation (1).

$$\left.\begin{aligned} F' &= \frac{1}{T'},\ T' = T'on + T'off \\ T'on &= \frac{\Delta I' \times Ls'}{Vin \times Ns/p - |Vout|},\ T'off = \frac{\Delta I' \times Ls'}{|Vout|} \end{aligned}\right\} \quad (1)$$

TABLE 1

| | | Vout (V) | | | | | | |
|---|---|---|---|---|---|---|---|---|
| | F' (kHz) | −4 | −12 | −28 | −44 | −60 | −72 | −88 |
| Vin (V) | 6 | 76.8 | 211.2 | 403.2 | 492.8 | 480.0 | 403.2 | 211.2 |
| | 9 | 77.9 | 220.8 | 455.5 | 621.9 | 720.0 | 748.8 | 727.5 |
| | 14 | 78.6 | 227.7 | 492.8 | 714.1 | 891.4 | 995.7 | 1096.2 |
| | 16 | 78.8 | 229.2 | 501.2 | 734.8 | 930.0 | 1051.2 | 1179.2 |
| | 20 | 79.0 | 231.4 | 513.0 | 763.8 | 984.0 | 1129.0 | 1295.4 |

In the semiconductor light source lighting circuit 300, assume that the turns ratio of the transformer 310 is set to 16.7 (the input=6 V is converted to the output=100 V), the inductance of the inductor 318 is set to 500 μH, and the hysteresis width is 0.1 A. Then, the relation among Vin, Vout and F' derived from Equation (1) is indicated by the following Table 1. Here, it is assumed that the input voltage variation is in a range of 6 V to 20 V, the output (load) voltage variation is in a range of −4 V to −88 V (22 LEDs with Vf=4 V are connected in series).

In this case, the switching frequency F' varies by a factor of about 17 between its maximum and its minimum. Although the range of fluctuation (variation) can be restricted by increasing the inductance, the circuit will then be larger. If a function is achieved where a large variation in the switching frequency F' is suppressed to lie within a predetermined range by calculating said variation therein from the input voltage and the output voltage, the scale of the control circuit will increase.

For the semiconductor light source control device 100 according to the present embodiment, the similar calculation is done. For the semiconductor light source control device 100 according to the present embodiment, the inductance of the inductor 144 is denoted by Ls and the switching frequency is denoted by F. Further, the forward voltage of the flywheel diode 142 is ignored because it is negligibly small. Then, "F" can be derived from the following Equation (2).

$$\left.\begin{aligned} F &= \frac{1}{T},\ T = Ton + Toff \\ Ton &= \frac{\Delta I \times Ls}{|Vt| - |Vout|},\ Toff = \frac{\Delta I \times Ls}{|Vout|} \end{aligned}\right\} \quad (2)$$

TABLE 2

| | | Vout (V) | | | | | | |
|---|---|---|---|---|---|---|---|---|
| | F (kHz) | −4 | −12 | −28 | −44 | −60 | −72 | −88 |
| Vt (V) | −100 | 76.8 | 211.2 | 403.2 | 492.8 | 480.0 | 403.2 | 211.2 |

In the semiconductor light source control device 100 according to the present embodiment, assume that the target voltage Vt is set to −100 V, the inductance of the inductor 144 is set to 500 μH, and the hysteresis width is 0.1 A. Then, the relation among Vt, Vout and F derived from Equation (2) is indicated by the following Table 2.

In this case, the fluctuation (variation) is suppressed to a factor of about 6.5. Notice here that the main parameter causing this fluctuation is the drive voltage Vout and that the target voltage Vt is practically fixed. Thus, the scale of the control circuit, which regulates the hysteresis width ΔI in order to suppress the variation in the switching frequency F, can be made relatively small.

As evident from the values obtained based on a theoretical calculation as shown in Table 2, the switching frequency F rises as the drive voltage Vout drops from −4 V to −44 V. Also, the switching frequency F drops as the drive voltage Vout drops from −44 V to −88 V. A boundary between the increase and the decrease in the switching frequency F is −50 V, which is equivalent to about a half of the output voltage of the flyback regulator 102 in a first stage (the preceding stage) (the input voltage of the down-converter 104 in a second stage (the subsequent stage)). Thus, control is performed such that, when Vout>−50 V, the lower the drive voltage Vout is, the larger the hysteresis width ΔI will be and such that, when Vout<−50 V, the lower the drive voltage Vout is, the smaller the hysteresis width ΔI will be. This control enables the switching frequency F to be easily made to lie within a predetermined range.

Also, it is found as above that, in the present embodiment, the boundary between the increase and the decrease in the switching frequency F is about a half of the output voltage of the flyback regulator 102. However, it is potentially possible that, in another embodiment where a different circuit configuration is implemented, this boundary may be one third or a quarter of the output voltage, for instance. In either case, it is commonly true that there may possibly exist a drive voltage Vout, between the maximum value and the minimum value of Vout, which gives a maximum value of the switching frequency F with the hysteresis width being a constant. Hence, if such a drive voltage Vout is found through experiments and simulation runs and then the circuit is configured such that the hysteresis width ΔI becomes the minimum with the thus found drive voltage Vout, the variation in the switching frequency can be suppressed more suitably.

Voffset regulates a circuit constant of the hysteresis width setting circuit 138 shown in FIG. 3 and is generated such that the voltage value is high near the drive voltage Vout of −50 V as in the graph of FIG. 3. The lower limit voltage and the upper limit voltage in Table 3 are voltages at the voltage division node of the twelfth resistor 182 and the thirteenth resistor 184 shown in FIG. 4, and correspond respectively to the lower limit of current Ith2 and the upper limit of current Ith1. The lower limit voltage and the upper limit voltage in Table 3 are calculated such that the resistance values of the eighth resistor 174, the twelfth resistor 182 and the thirteenth resistor 184 as well as the control source voltage Vcc are set and then the lower limit voltage and the upper limit voltage are calculated from the offset voltage Voffset. The average current in Table 3 is an average value of the upper limit of current Ith1 and the lower limit of current Ith2. The switching frequency is derived using ΔI=Ith1−Ith2, Vt=−100 V, and Ls=200 μH in Equation (2).

It is found that even though Ls is reduced from 500 μH to 200 μH, the switching frequency can be made to lie in a range of close to 400 kHz up to close to 550 kHz. In other words, by employing the semiconductor light source control device 100 according to the present embodiment, the inductor for smoothing out the drive current Iout can be downsized.

A comparison is now made between the semiconductor light source lighting circuit 300 according to the comparative example and the semiconductor light source control device 100 according to the present embodiment. Although, in the semiconductor light source control device 100, the output capacitor 128 of the flyback regulator 102 and the second switching element 140 of the down-converter 104 are additionally provided, the reset circuit 308 can be eliminated from the semiconductor light source lighting circuit 300. Thus, the circuit scales for the semiconductor light source lighting circuit 300 according to the comparative example and the semiconductor light source control device 100 according to the present embodiment are almost equal to each other.

The description has been given of the configurations and the operations of the semiconductor light source control device according to the embodiments. These embodiments are intended to be illustrative only and are therefore merely exemplary and it will be obvious to those skilled in the art that

TABLE 3

| Vout (V) | Voffset | LOWER LIMIT VOLTAGE | UPPER LIMIT VOLTAGE | Ith2 | Ith1 | AVERAGE CURRENT | SWITCHING FREQUENCY |
|---|---|---|---|---|---|---|---|
| −4 | 0.25 | 0.2356 | 0.2456 | 1.178 | 1.228 | 1.203 | 382.2 kHz |
| −8 | 0.37 | 0.2332 | 0.2480 | 1.166 | 1.240 | 1.203 | 498.7 kHz |
| −12 | 0.48 | 0.2309 | 0.2503 | 1.154 | 1.252 | 1.203 | 542.3 kHz |
| −16 | 0.60 | 0.2285 | 0.2527 | 1.143 | 1.264 | 1.203 | 555.8 kHz |
| −20 | 0.72 | 0.2262 | 0.2551 | 1.131 | 1.275 | 1.203 | 553.7 kHz |
| −24 | 0.83 | 0.2238 | 0.2574 | 1.119 | 1.287 | 1.203 | 542.8 kHz |
| −28 | 0.95 | 0.2215 | 0.2598 | 1.107 | 1.299 | 1.203 | 526.1 kHz |
| −32 | 1.07 | 0.2191 | 0.2621 | 1.095 | 1.311 | 1.203 | 505.7 kHz |
| −36 | 1.18 | 0.2167 | 0.2645 | 1.084 | 1.322 | 1.203 | 482.6 kHz |
| −40 | 1.30 | 0.2144 | 0.2668 | 1.072 | 1.334 | 1.203 | 457.6 kHz |
| −44 | 1.42 | 0.2120 | 0.2692 | 1.060 | 1.346 | 1.203 | 431.0 kHz |
| −48 | 1.54 | 0.2097 | 0.2716 | 1.048 | 1.358 | 1.203 | 403.4 kHz |
| −52 | 1.56 | 0.2093 | 0.2720 | 1.046 | 1.360 | 1.203 | 398.2 kHz |
| −56 | 1.46 | 0.2113 | 0.2700 | 1.056 | 1.350 | 1.203 | 419.6 kHz |
| −60 | 1.36 | 0.2132 | 0.2680 | 1.066 | 1.340 | 1.203 | 438.2 kHz |
| −64 | 1.26 | 0.2152 | 0.2660 | 1.076 | 1.330 | 1.203 | 453.4 kHz |
| −68 | 1.16 | 0.2172 | 0.2640 | 1.086 | 1.320 | 1.203 | 464.4 kHz |
| −72 | 1.06 | 0.2192 | 0.2621 | 1.096 | 1.310 | 1.203 | 469.9 kHz |
| −76 | 0.97 | 0.2211 | 0.2601 | 1.106 | 1.300 | 1.203 | 468.4 kHz |
| −80 | 0.87 | 0.2231 | 0.2581 | 1.116 | 1.291 | 1.203 | 457.3 kHz |
| −84 | 0.77 | 0.2251 | 0.2561 | 1.125 | 1.281 | 1.203 | 433.1 kHz |
| −88 | 0.67 | 0.2271 | 0.2542 | 1.135 | 1.271 | 1.203 | 390.0 kHz |

Exemplary settings of parameters for the semiconductor light source control device 100 according to the present embodiment are shown in the following Table 3.

various modifications to constituting elements and processes could be developed and that such modifications are also within the scope of the present invention.

In the above-described embodiments, the description has been given of a case where the elements of the down-converter 104 are arranged such that the second switching element 140 is placed on the cathode side of the flywheel diode 142 and such that the inductor 144 is placed on the anode side thereof. However, this arrangement should not be considered as limiting. It suffices that the flywheel diode is connected in parallel with the output capacitor 128 of the flyback regulator 102. It suffices that the second switching element is provided on a route that leads to the LEDs from one end of the output capacitor 128 and that returns to the other end of the output capacitor 128 from the LEDs. And it suffices that the second switching element is provided between the output capacitor 128 and the flywheel diode. The on/off of the second switching element may be controlled based on the drive current. It suffices that the inductor 144 is provided on the route of the drive current Iout and is provided between the flywheel diode and the LEDs.

Figure 7A:
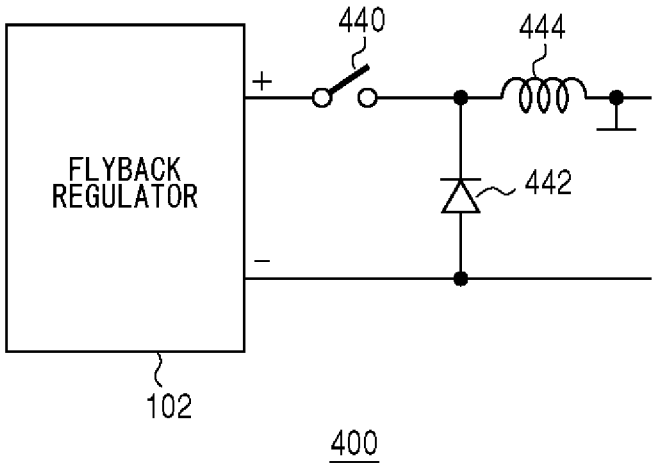
FIGS. 7A to 7C are circuit diagrams showing semiconductor light source control devices according to a first modification, a second modification and a third modification, respectively.
Figure 7B:
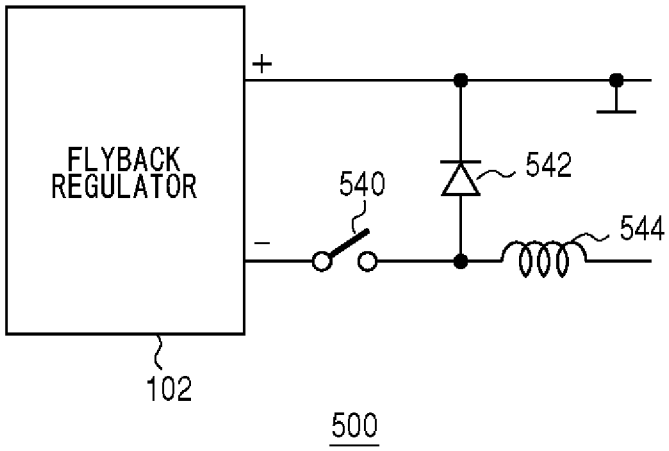
Figure 7C:
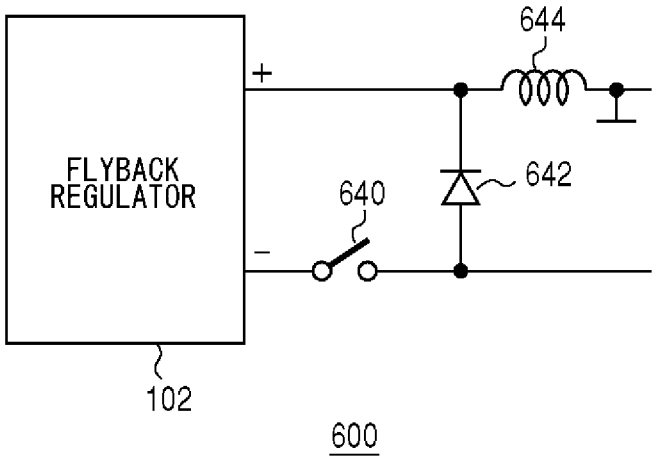

FIGS. 7A to 7C are circuit diagrams showing semiconductor light source control devices 400, 500 and 600 according to a first modification, a second modification and a third modification, respectively. FIG. 7A shows a configuration of the semiconductor light source control device 400 according to the first modification. One end of a second switching element 440 is connected to a high-potential-side output of the flyback regulator 102, and the other end thereof is connected to a cathode of a flywheel diode 442. One end of an inductor 444 is connected to a connection node of the other end of the second switching element 440 and the cathode of the flywheel diode 442. The other end of the inductor 444 is grounded and is a high-potential-side output terminal leading to the LEDs. An anode of the flywheel diode 442 is connected to a low-potential-side output of the flyback regulator 102 and is a low-potential-side output terminal leading to the LEDs.

FIG. 7B shows a configuration of the semiconductor light source control device 500 according to the second modification. A cathode of a flywheel diode 542 is connected to a high-potential-side output of the flyback regulator 102 and forms a high-potential-side output to the LEDs. One end of a second switching element 540 is connected to a low-potential-side output of the flyback regulator 102, and the other end thereof is connected to an anode of the flywheel diode 542. One end of an inductor 544 is connected to a connection node of the other end of the second switching element 540 and the anode of the flywheel diode 542. The other end of the inductor 544 is a low-potential-side output terminal leading to the LEDs.

FIG. 7C shows a configuration of the semiconductor light source control device 600 according to the third modification. One end of a second switching element 640 is connected to a low-potential-side output of the flyback regulator 102, and the other end thereof is connected to an anode of a flywheel diode 642. A connection node of the other end of the second switching element 640 and the anode of the flywheel diode 642 forms a lower-potential-side output to the LEDs. A cathode of the flywheel diode 642 is connected to one end of an inductor 644. A connection node of the cathode of the flywheel diode 642 and one end of the inductor 644 is connected to a high-potential-side output of the flyback regulator 102. The other end of the inductor 644 is grounded and is a high-potential-side output terminal leading to the LEDs.

By employing the semiconductor light source control device 400, 500 and 600 according to the first, second and third modifications, respectively, the overshoot and the undershoot of the drive current Iout can be reduced similarly to the semiconductor light source control device 100 according to the embodiment.

In the above-described embodiments, the description has been given of a case where the high potential side of the output, namely the anode side of a plurality of LEDs, is grounded and thereby the negative output is achieved. However, this should not be considered as limiting and, for example, the anode side of the plurality of LEDs may be connected to a terminal to which the DC voltage such as the battery voltage Vbat is applied.

In the above-described embodiments, the description has been given of a case where the switching frequency is not measured in real time and, instead, a relation between the drive voltage Vout and the hysteresis width ΔI is determined based on a known relation between the drive voltage Vout and the switching frequency. And the circuit is configured such that the hysteresis width ΔI varies according to the thus determined relation. However, this should not be considered as limiting. For example, the semiconductor light source control device may include a circuit that measures the switching frequency of the second switching element 140, and the hysteresis width may be regulated such that the thus measured switching frequency lies within a targeted frequency range.

In the above-described embodiments, the description has been given of a case where the semiconductor light source control device 100 includes N bypass switches 110-1 to 110-N. However, this should not be considered as limiting, and the bypass switches may be provided separately from the semiconductor light source control device.

In the above-described embodiments, the description has been given of a case where the drive current is subjected to the hysteresis control. However, this should not be considered as limiting. For example, the duty ratio of the second switching element 140 may be controlled such that a voltage, for which the voltage drop Vm has been filtered appropriately, is brought close to a reference voltage corresponding to a target current.

In the above-described embodiments, the description has been given of a case where the drive current Iout is generated by the flyback regulator 102 and the down-converter 104 in combination and where configured is a driver circuit that performs control such that the amount of the generated drive current Iout is brought close to the target value. However, this should not be considered as limiting. For example, as the aforementioned driver, a circuit like one shown in FIG. 6 may be used or a flyback regulator, for which the current feedback control is performed, may be used.

Figure 8:
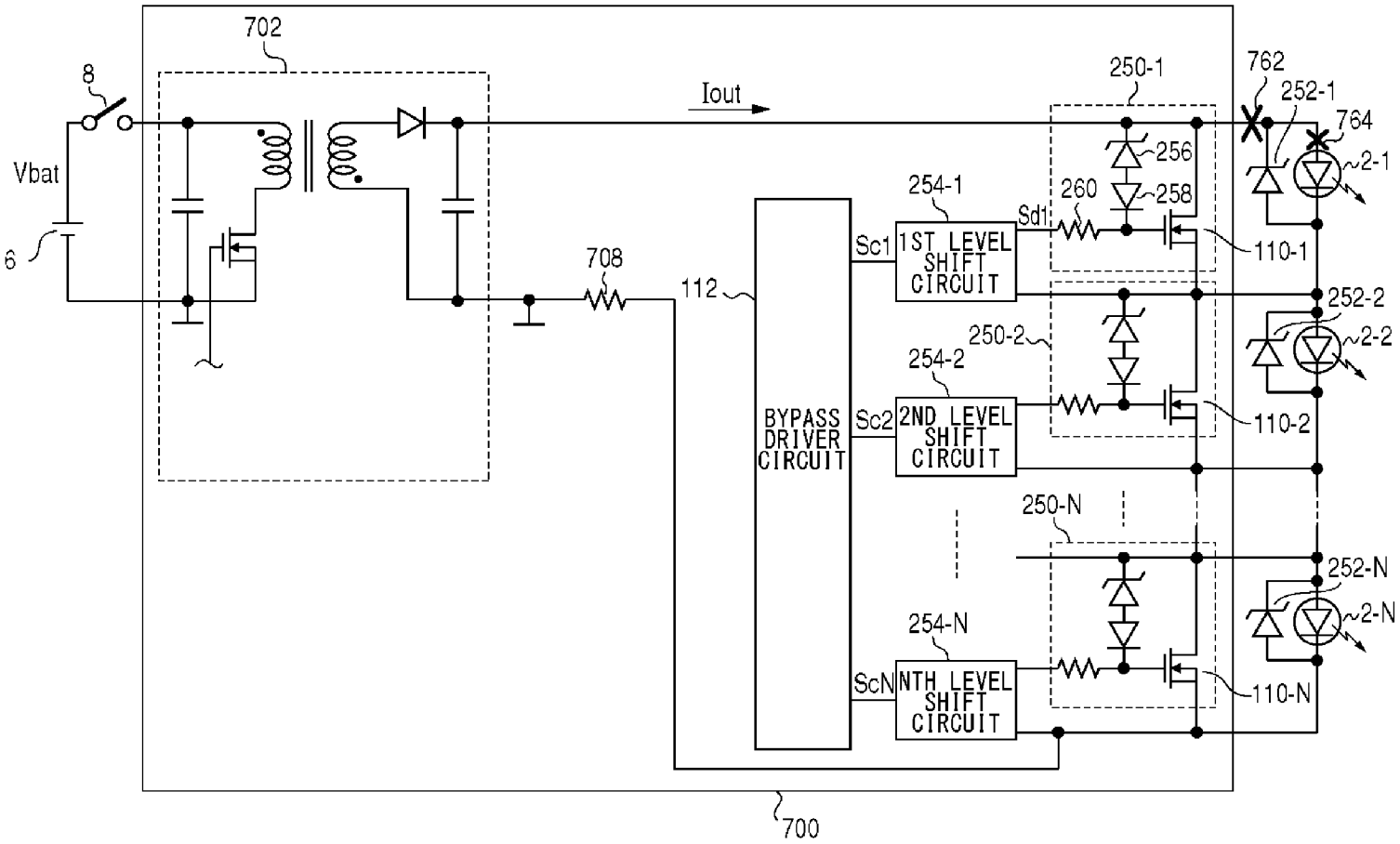
FIG. 8 is a circuit diagram showing a configuration of a semiconductor light source control device and its constituent members and components connected thereto according to a fourth modification.

FIG. 8 is a circuit diagram showing a configuration of a semiconductor light source control device 700 and its constituent members and components connected thereto according to a fourth modification. The semiconductor light source control device 700 includes a flyback regulator 702, a current sensing resistor 708, N bypass/limiter circuits 250-1 to 250-N, N level-shift circuits 254-1 to 254-N.

The limiting value of the maximum voltage that the flyback regulator 702 outputs is set to the sum of forward voltages Vf or more, in consideration of the case when all of N LEDs, connected in series, light up. For example, the maximum value of the forward voltage Vf for each LED is set to 6 V, and the limiting value thereof when thirty LEDs are connected in series is set to 180 V or more. At the instant that a contact failure or disconnection occurs in the wiring marked with "X" and denoted by a reference numeral 762 shown in FIG. 8, no drive current Iout flows to the LEDs. Thus, the output voltage of the flyback regulator 702 rises toward a voltage value of 180 V. As a control circuit (not shown) detects that the drive current Iout does not flow thereto, the control circuit checks to identify which wiring or LED the disconnection has occurred and then turns on the first bypass switch 110-1 in the circuit shown in FIG. 8 so that the other LEDs can light. This process takes time of several tens to several hundreds of milliseconds.

If, in this case, the semiconductor light source control device does not have the limiter zener diode 256 and the back-flow preventing diode 258, the output voltage of the flyback regulator 702 will reach 180 V before the first bypass switch is turned on. At this time, if the average value of the forward voltage Vf of each LED in use (at room temperature) is set to 4 V and if it is set to 3V when almost no current flows thereto, a voltage, which is 90 V (=180[V]−3[V]×30 LEDs), is applied to the first bypass switch. Thus, as for every one of 30 bypass switches, an element having a voltage of 100 V has to be selected in consideration of contact failure and disconnection even though only a several V is normally applied.

Next, when a contact failure or disconnection occurs in the wiring marked with "x" and denoted by a reference numeral 764 in FIG. 8, the aforementioned 90 V flows to the first electrostatic protection zener diode while almost no current flows, and 60 V (=180[V]−4[V]×30 LEDs) is applied thereto while the control current flows. Assume herein that the zener voltage of the first electrostatic protection zener diode is 20 V. Then, 20 W (=20[V]×1[A], where the control current is 1 A) is applied to the first electrostatic protection zener diode for the duration of several tens to several hundreds of milliseconds. This means that since 90 V or 60 V is a voltage higher than 20 V, an element, which can withstand against a larger power consumption, needs to be selected. In order to avoid this, the zener voltage of the first electrostatic protection zener diode is to be set to 90 V or above; in that case, it is difficult for such the element to achieve the electrostatic protection role required in the first place.

On the other hand, the semiconductor light source control device 700 according to the fourth modification is equipped with the first bypass/limiter circuit 250-1. Thus, the upper limit of voltage applied to the first bypass switch 110-1 is restricted even in the event that a conduction failure and disconnection occur. Hence, it is no longer necessary to select an element, having a high breakdown voltage of 100 V or above, as the first bypass switch 110-1. Also, if the control voltage in the first bypass/limiter circuit 250-1 is set to the zener voltage of the first electrostatic protection zener diode 252-1 or below, a smaller zener diode can be selected.

In the semiconductor light source control device 100 according to the embodiment, the order of several kV is required for the bypass switch if no limiter function is provided. Thus, the advantageous effects of restricting and limiting the breakdown voltage as a result of provision of the limiter function are more apparent and remarkable in the embodiments.

In the above-described embodiments, the description has been given of a case where the LEDs and the bypass switches are operated in a one-to-one correspondence manner. However, this should not be considered as limiting, and the turning on and off of a plurality of LEDs may be controlled by a single bypass switch. Consider, for example, a case where a single bypass switch is connected to two LEDs, which are connected in series. In this case, the sum of the maximum forward voltages Vf of the LEDs is 12 V and the zener voltage of the electrostatic protection zener diode is 40 V. Thus, the zener voltage of the limiter zener diode is preferably in a range of 9 V to 37 V. If the zener voltage of the limiter zener diode is set to 20 V, for instance, it will suffice that an element having a breakdown voltage of 30 V be selected as the bypass switch.

While the preferred embodiments of the present invention have been described using specific terms, such description is for illustrative purposes only, and it is to be understood that changes and variations may be made without departing from the spirit or scope of the appended claims.

What is claimed is:

1. A light source control device comprising:

a driver circuit that generates a drive current flowing through a plurality of semiconductor light sources connected in series and that performs control such that an amount of the drive current is brought close to a target value; and a bypass/limiter circuit connected in parallel with at least part of the plurality of semiconductor light sources, wherein the bypass/limiter circuit includes:

a bypass switch including an N-channel MOSFET having a gate, a source and a drain, wherein ON/OFF state of the bypass switch is controlled according to a drive signal applied across the gate and the source of the N-channel MOSFET; and a clamp circuit provided between the gate and the drain of the N-channel MOSFET, wherein the clamp circuit clamps the gate-drain voltage of the N-channel MOSFET below a predetermined voltage level VCL, and wherein in a condition where a low voltage VL is applied across the gate and the source of the N-channel MOSFET such that the bypass switch is in off-state, a voltage across the at least part of the plurality of semiconductor light sources is clamped below an upper limit given by VL+VCL.

2. The light source control device according to claim 1, wherein a plurality of zener diodes are connected in parallel with and in reverse across respective ones of the plurality of semiconductor light sources, and wherein the upper limit is lower than a zener voltage determined by at least one zener diode corresponding to the at least part of the plurality of semiconductor light sources.

3. The light source control device according to claim 1, the driver circuit comprising:

a switching regulator that converts an input voltage into a target voltage;

a flywheel diode connected in parallel with an output capacitor of the switching regulator;

a switching element provided on a path from one end of the output capacitor to the other end of the output capacitor via the plurality of semiconductor light sources, the switching element being provided between output capacitor and the flywheel diode; and an inductor provided on the path and provided between the flywheel diode and the plurality of semiconductor light sources.

4. The light source control device according to claim 3, the driver circuit further comprising a control circuit that turns off the switching element when an amount of the drive current exceeds a first threshold value, and that turns on the switching element when the amount of the drive current falls below a second threshold value, which is smaller than the first threshold value.

5. The light source control device according to claim 1, wherein the clamp circuit includes a zener diode provided between the gate and the drain of the N-channel MOSFET in a direction where a cathode of the zener diode comes to the side of the drain.

6. The light source control device according to claim 5, wherein the clamp circuit further includes a diode provided between the gate and the drain of the N-channel MOSFET in series with the zener diode in a direction where a cathode of the diode comes to the side of the gate.

7. The light source control device according to claim 5, further comprising a level shift circuit which receives a control signal indicative of the ON/OFF state of the bypass switch, and level shifts the control signal so as to generate the drive signal across the gate and the source of the N-channel MOSFET.

* * * * *